US010877424B2

(12) United States Patent
Cohen et al.

(10) Patent No.: US 10,877,424 B2
(45) Date of Patent: Dec. 29, 2020

(54) ELECTROPHOTOGRAPHIC PRINTER HAVING A CLEANING ELEMENT

(71) Applicant: HP Indigo B.V., Amstelveen (NL)

(72) Inventors: Lavi Cohen, Ness Ziona (IL); Minedys Macias Guzman, San Diego, CA (US)

(73) Assignee: HP Indigo B.V., Amstelveen (NL)

( * ) Notice: Subject to any disclaimer, the term of this patent is extended or adjusted under 35 U.S.C. 154(b) by 0 days.

(21) Appl. No.: 16/608,174

(22) PCT Filed: Sep. 15, 2017

(86) PCT No.: PCT/US2017/051889
§ 371 (c)(1),
(2) Date: Oct. 24, 2019

(87) PCT Pub. No.: WO2019/055029
PCT Pub. Date: Mar. 21, 2019

(65) Prior Publication Data
US 2020/0201236 A1 Jun. 25, 2020

(51) Int. Cl.
*G03G 21/00* (2006.01)

(52) U.S. Cl.
CPC ..... *G03G 21/0011* (2013.01); *G03G 21/0005* (2013.01); *G03G 21/0058* (2013.01); *G03G 2221/0005* (2013.01)

(58) Field of Classification Search
CPC ..... G03G 21/0005; G03G 21/0058; G03G 21/0094; G03G 21/0011; G03G 21/0088; G03G 2221/0005; G03G 2221/0026; G03G 2221/0089
See application file for complete search history.

(56) References Cited

U.S. PATENT DOCUMENTS

| | | | | |
|---|---|---|---|---|
| 3,986,450 | A | 10/1976 | Zimmer | |
| 4,870,465 | A * | 9/1989 | Lindblad | G03G 21/0005 399/347 |
| 4,974,030 | A * | 11/1990 | Tokunaga | G03G 21/0058 399/347 |
| 5,349,426 | A * | 9/1994 | Kudoh | G03G 21/0058 399/350 |
| 5,701,559 | A * | 12/1997 | Ootaka | G03G 21/0064 399/149 |
| 5,975,988 | A | 11/1999 | Christianson | |
| 6,069,776 | A | 5/2000 | Hasegawa et al. | |
| 6,969,412 | B2 | 11/2005 | Welygan et al. | |
| 7,512,368 | B2 | 3/2009 | Zess et al. | |
| 9,261,812 | B1 | 2/2016 | DiGirolamo et al. | |

(Continued)

FOREIGN PATENT DOCUMENTS

| | | |
|---|---|---|
| JP | 59111673 | 6/1984 |
| WO | WO 2017020924 A1 | 2/2017 |

*Primary Examiner* — Sandra Brase
(74) *Attorney, Agent, or Firm* — Thorpe North & Western LLP

(57) ABSTRACT

The present disclosure relates to an electrophotographic printer comprising a photoconductive cylinder, and a cleaning element comprising an absorbent foam substrate. The absorbent foam substrate has an abrasive material disposed on at least an outer surface of the absorbent foam substrate. At least part of the outer surface of the absorbent foam substrate is engageable with the photoconductive cylinder.

17 Claims, 2 Drawing Sheets

(56) References Cited

U.S. PATENT DOCUMENTS

| | | | | |
|---|---|---|---|---|
| 2007/0212139 | A1* | 9/2007 | Sugiura | G03G 21/0035 399/353 |
| 2010/0226702 | A1* | 9/2010 | Nuriel | G03G 21/0058 399/345 |
| 2010/0251916 | A1* | 10/2010 | Peles | G03G 21/007 101/492 |
| 2013/0327236 | A1 | 12/2013 | Kahatabi et al. | |
| 2014/0348536 | A1* | 11/2014 | Ohashi | G03G 21/1647 399/110 |

* cited by examiner

ELECTROPHOTOGRAPHIC PRINTER HAVING A CLEANING ELEMENT

BACKGROUND

Electrophotographic printing devices, for example, laser printing devices, form images on media like paper. In general, a photoconductive drum is charged over its entire surface, and then selectively discharged in accordance with the image to be formed. Charged colorant such as dry or liquid ink or toner adheres to locations on the drum that have been discharged, and the colorant is then directly or indirectly transferred from the drum to the media. The photoconductive drum is discharged and remaining colorant on the drum is removed before repeating the image-formation process.

BRIEF DESCRIPTION OF THE FIGURES

Various features will be described, by way of example only, with reference to the following figures, in which.

DETAILED DESCRIPTION

Figure 1:
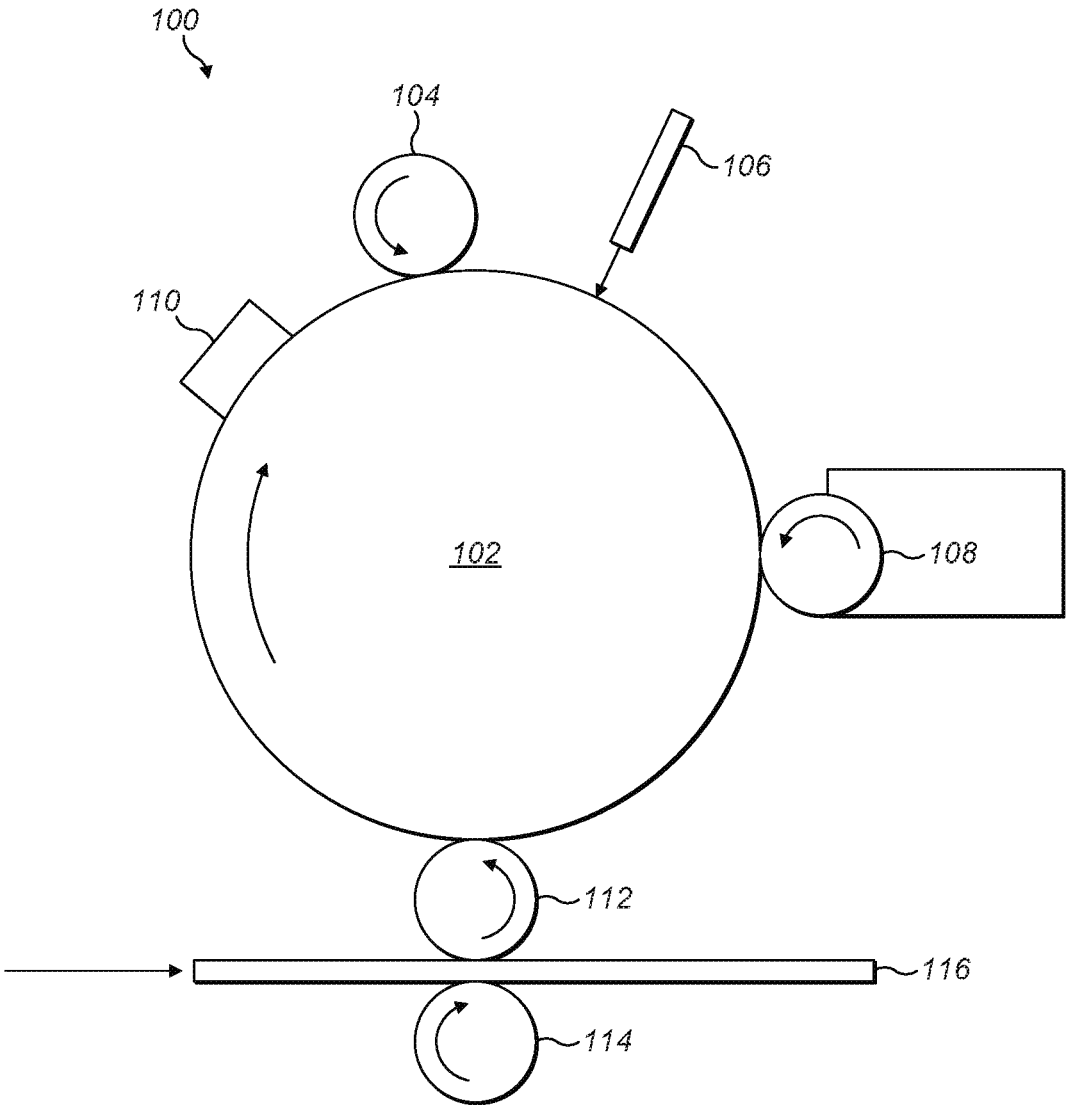
FIG. 1 is a schematic drawing of an example electrophotographic printer.

Before the present disclosure is disclosed and described, it is to be understood that this disclosure is not limited to the particular method steps and materials disclosed herein because such method steps and materials may vary. It is also to be understood that the terminology used herein is used for the purpose of describing particular examples. The terms are not intended to be limiting because the scope is intended to be limited by the appended claims and equivalents thereof.

It is noted that, as used in this specification and the appended claims, the singular forms "a," "an," and "the" include plural referents unless the context clearly dictates otherwise.

As used herein, "carrier liquid," "carrier liquid," or "carrier vehicle" refers to liquid in which polymers, pigment particles, colorant, charge directors and other additives can be dispersed to form a liquid electrostatic composition or electrophotographic composition. The carrier liquids may include a mixture of a variety of different agents, such as surfactants, co-solvents, viscosity modifiers, and/or other possible ingredients.

As used herein, "liquid electrostatic composition" or "liquid electrophotographic composition" generally refers to a composition that is typically suitable for use in an electrostatic printing process, sometimes termed an electrophotographic printing process.

As used herein, "electrostatic printing" or "electrophotographic printing" generally refers to the process that provides an image that is transferred from a photo imaging substrate either directly, or indirectly via an intermediate transfer member, to a print substrate, As such, the image is not substantially absorbed into the photo imaging substrate on which it is applied. Additionally, "electrophotographic printers" or "electrostatic printers" generally refer to those printers capable of performing electrophotographic printing or electrostatic printing, as described above. "Liquid electrophotographic printing" is a specific type of electrophotographic printing where a liquid ink is employed in the electrophotographic process rather than a powder toner. An electrostatic printing process may involve subjecting the electrostatic ink composition to an electric field, e.g. an electric field having a field gradient of 50-400 V/μm, or more, in some examples 600-900 V/μm, or more, in some examples 1000 V/cm or more, or in some examples 1500 V/cm or more.

As used herein, the term "about" is used to provide flexibility to a numerical range endpoint by providing that a given value may be a little above or a little below the endpoint to allow for variation in test methods or apparatus. The degree of flexibility of this term can be dictated by the particular variable and would be within the knowledge of those skilled in the art to determine based on experience and the associated description herein.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Concentrations, amounts, and other numerical data may be expressed or presented in this disclosure in a range format. It is to be understood that such a range format is used merely for convenience and brevity and thus should be interpreted flexibly to include not just the numerical values explicitly recited as the limits of the range, but also to include all the individual numerical values or sub-ranges encompassed within that range as if each numerical value and sub-range is explicitly recited. As an illustration, a numerical range of "about 1 wt % to about 5 wt %" should be interpreted to include not just the explicitly recited values of about 1 wt % to about 5 wt %, but also include individual values and subranges within the indicated range. Thus, included in this numerical range are individual values such as 2, 3.5, and 4 and sub-ranges such as from 1-3, from 2-4, and from 3-5, etc. This same principle applies to ranges reciting a single numerical value. Furthermore, such an interpretation should apply regardless of the breadth of the range or the characteristics being described.

Unless otherwise stated, any feature described herein can be combined with any aspect or any other feature described herein.

In one aspect, there is provided an electrophotographic printer comprising a photoconductive cylinder, and a cleaning element comprising an abrasive material disposed on at least an outer surface of an absorbent foam substrate. At least part of the outer surface of the absorbent foam substrate is engageable with the photoconductive cylinder.

In one example, the cleaning element is positioned such that at least part of said outer surface engages the photoconductive cylinder.

In another aspect, there is provided an apparatus (or assembly) for cleaning a photoconductive cylinder of an electrophotographic printer. The apparatus comprises a cleaning element comprising an abrasive material disposed on at least an outer surface of an absorbent foam substrate, wherein at least part of the outer surface is engageable with the photoconductive cylinder. The apparatus also comprises a wetting element for delivering liquid to the absorbent foam substrate; and a drying (e.g. squeezing) element for removing liquid from the absorbent foam substrate.

In yet another aspect, there is provided an electrophotographic printing process comprising a) selectively applying a electrophotographic composition to the outer surface of a photoconductive cylinder;

b) transferring the electrophotographic composition from the photoconductive cylinder onto a print substrate; and c) contacting the photoconductive cylinder with a cleaning element comprising an absorbent foam substrate having an abrasive material disposed on at least an outer surface, wherein the abrasive material contacts the photoconductive cylinder and at least partially removes any remnant electrophotographic composition from the photoconductive cylinder.

In an electrophotographic printing device, a photoconductive cylinder is used to transfer ink onto a print medium to form images on the print medium. After ink has been transferred to medium, the photoconductive cylinder may be discharged. The remaining ink may be removed before the image-formation process is repeated.

Removal of the ink may be achieved by rotating the photoconductive cylinder against a sponge impregnated with a cleaning liquid. The photoconductive cylinder may then be rotated against a wiper to wipe cleaning liquid from the cylinder before the image-formation process is repeated.

While such sponges and wipers may be effective at removing freshly deposited ink, the present inventors have found that older ink deposits may become increasingly difficult to remove, as the ink becomes exposed to plasma generated during the electrophotographic printing process. This may be because reactions between the ink and the plasma can give rise to the formation of adherent deposits or contaminants that can build up on the surface of the photoconductive cylinder. Over time, the build-up of such contaminants can visibly affect image quality.

The present inventors have found that it may be possible to use certain abrasives to abrade such adherent contaminants from the photoconductive cylinder. However, when incorporated into an electrophotographic printer, such abrasives can cause detriment to the electrophotographic printing process. In particular, the present inventors have found that, once abraded from the surface of the photoconductive cylinder, the contaminants can disperse and reach other printer components, causing damage to the printer and printing process.

In the present disclosure, the present inventors have developed an arrangement for removing such contaminants from the photoconductive cylinder, while reducing the risk of the removed contaminants from reaching other components of the printer. In particular, the present inventors have developed a cleaning element comprising an absorbent foam substrate having an abrasive material disposed on at least an outer surface of the substrate. At least part of the outer surface of the cleaning element can be engaged with the photoconductive cylinder to abrade any adherent contaminants from the surface of the cylinder.

Because the cleaning element includes an absorbent foam, the foam can absorb and deliver liquid (e.g. cleaning liquid) to the surface of the photoconductive cylinder. Accordingly, liquid can be absorbed by the absorbent foam and used to wet the surface of the photoconductive cylinder during the abrasion. This liquid can help to trap particles of any abraded contaminants from the photoconductive cylinder's surface, reducing the risk of such particles dispersing and causing damage to other parts of the printer. The liquid can also help to cool the surface of the photoconductive cylinder, reducing the risk of over-heating. The liquid, now containing particles of abraded contaminants, can be re-absorbed and retained by the absorbent foam substrate, reducing the risk of such particles dispersing and reaching other parts of the printer. Once saturated with abraded contaminants, the cleaning element can be replaced. However, in some examples, the cleaning element can be at least partially dried to remove at least some of the contaminated liquid (e.g. contaminated cleaning liquid) before being wet once again with fresh e.g. cleaning liquid for the cleaning process to be repeated. In some examples, the liquid may be a cleaning liquid such as imaging oil, for example, iso-paraffin.

In some examples, a wetting element can be used to wet the cleaning element by delivering liquid, for example, cleaning liquid to the absorbent foam substrate. The wetting element may be a sponge, brush or other liquid transfer device that can be placed in fluid communication with the cleaning element. In some examples, a drying element can be provided e.g. downstream of the wetting element to remove e.g. excess liquid from the cleaning element. The removed liquid may be contaminated with particles of contaminant removed from the surface of the photoconductive cylinder. The drying element may be a wiper or a squeezing element, for example, a squeegee.

In one example, the absorbent foam substrate may be resilient. Such a substrate may deform when the absorbent foam substrate is pressed into contact with the photoconductive cylinder. By deforming in this way, the pressure between the abrasive material on the absorbent foam substrate and the photoconductive cylinder may be reduced. This can reduce the risk of damage (e.g. scratching) of the photoconductive cylinder's surface. The resilience of the foam may allow the cleaning element to conform at least in part to the shape of the photoconductive cylinder, allowing wide nip contact between the cleaning element at the photoconductive cylinder's surface. In one example, the absorbent foam substrate may be an absorbent foam roller having an abrasive material disposed on at least an outer surface of the absorbent foam roller. In use, such a roller (i.e. cleaner roller) is positioned relative to the photoconductive cylinder, such that the abrasive material is in contact with the photoconductive cylinder's surface. By rotating the photoconductive cylinder relative to the cleaner roller, any adherent deposits or contaminants on the photoconductive cylinder may be abraded away by the abrasive material. As described above, the absorbent nature of the substrate (in this example, a foam roller) allows liquid to be absorbed from and delivered to the photoconductive cylinder. Accordingly, in use, the cleaner roller may be wet with liquid e.g. cleaning liquid, which may be absorbed and delivered to the photoconductive cylinder's surface. This liquid can be used to trap any deposits or contaminants that have been abraded away from the photoconductive cylinder's surface by the abrasive material, reducing the risk of such contaminants from dispersing elsewhere within the printer. Delivery of liquid onto the photoconductive cylinder may also help to cool the cylinder, reducing the risk of overheating. The liquid, now contaminated with abraded deposits/contaminants, may then be absorbed within the absorbent substrate (e.g. foam roller). In some examples, a drying element can be provided to remove contaminated liquid (e.g. contaminated cleaning liquid) from the cleaning element. Fresh liquid (e.g. cleaning liquid) may then be delivered to the cleaning roller using, for example, a wetting element.

In one example, one of the photoconductive cylinder and the cleaning roller rotates while the other remains stationary. In another example, both the photoconductive cylinder and the cleaning roller rotate in opposite directions.

In one example, the cleaning roller rotates as the photoconductive roller rotates during its normal mode of operation.

In one example, the cleaning roller has a smaller diameter than the photoconductive cylinder. In one example, the cleaning roller has a diameter that is 10 to 700 mm, for example, 10 to 300 mm. In one example, the cleaning roller has a diameter that is 10 to 200 mm, for instance, 10 to 100 mm or 10 to 40 mm in diameter.

The absorbent foam substrate may be formed of any suitable material. For instance, the absorbent foam substrate may be formed of a polymer foam. An example of a suitable polymer may be polyurethane. The foam substrate may comprise an open cell foam. The foam may draw liquid away from the surface of the photoconductive cylinder into the foam.

Other suitable foam materials include, for example, polyurethane silicone, nitrile, ethylene-propylene, butadiene, styrene-butadiene, isoprene and natural rubbers or combinations thereof. In one embodiment, foam may be composed of an open-cell polyurethane foam, such as a polyether or polyester based polyurethane foam. For polyurethane foam, production may be based on the reaction of an isocyanate with a molecule comprising either an alcohol or amine functional group as a source of active hydrogen. To form a polyurethane polymer, di- or polyisocyanates may be reacted with polyfunctional compounds, for instance, polyols. Foam cell formation may be based on the reactions of isocyanate with water to form an aromatic amine and carbon dioxide with the carbon dioxide causing the cell formation and foaming. Polymeric foam cells may also be formed by introducing a chemical blowing agent that releases a gas, such as nitrogen and/or carbon dioxide, to the polymeric foam material when the polymeric foam material is in a liquid state. The foam cells may also be formed by injecting a gas, such as air, to the polymeric foam material when the polymeric foam material is in a liquid state and frothing the liquid at high speed. The cured foam material may be cut into sleeves according to the desired shape and size of foam member and, in the case of a roller, adhered to a shaft. The adhered foam material may then be ground to its final dimensions.

Any suitable abrasive material may be employed, In one example, the abrasive material comprises abrasive particles. The abrasive particles may be deposited onto the resilient foam using a binder, cement or adhesive, Examples of suitable abrasive particles include ceramic particles. Suitable particles include oxide, carbonate or carbide particles. Examples include silica, aluminium oxide, titanium dioxide, calcium carbonate, tungsten carbide and silicon carbide.

The abrasive material may be disposed on at least an outer surface of the absorbent foam substrate. In some examples, the abrasive material forms a discontinuous layer over the outer surface of the absorbent foam substrate. In this way, the abrasive material does not completely inhibit the passage of liquid into the absorbent foam substrate and it is possible to maintain fluid interaction with the pore structure of the foam. In other words, liquid that comes into contact with the outer surface of the cleaning element can be absorbed into the absorbent foam substrate. In some examples, the discontinuous layer may be provided by depositing particles of abrasive material onto the absorbent foam substrate, whereby the pore structure of the absorbent foam substrate can be accessed through gaps between the particles in the abrasive layer. In some examples, the discontinuous layer may be provided by masking portions of the absorbent layer and depositing absorbent material on the unmasked portions.

The abrasive particles may have n average particle size of 0.01 microns to 1 mm, for example, 0.02 to 100 microns or 0.02 to 50 microns. In some examples, the abrasive particle size may be 0.05 to 10 microns.

Where abrasive particles are employed, the particles may be deposited on the surface and in at least some of the surface pores of the resilient foam substrate.

By depositing abrasive particles on at least part of the outer surface of the resilient foam substrate, it is possible to provide the outer surface with a rough or abrasive surface while maintaining fluid interaction with the pore structure of the foam, This can allow a balance between an abrasive and absorptive function to be achieved. The density of the surface coating of abrasive particles may be adjusted to provide a balance between abrasive and absorptive functions.

The abrasive material (e.g. abrasive particles) may be deposited on all or some of the outer surface of the cleaning element. In some examples, the abrasive material may be deposited in a pre-defined pattern. In some examples, the abrasive material is disposed on selected regions of the outer surface of the foam substrate.

The abrasive material may have a hardness that is less than the hardness of the material used to form the outer surface of the photoconductive cylinder but greater than the hardness of the adherent deposits formed by exposing remnant ink on the photoconductive cylinder to plasmas e.g. formed during operation of the printer. The abrasive material may have a hardness in the range of mohs 2 to mohs 9, for example, mohs 3 to mohs 9 or mohs 4 to mohs 9.

Where the abrasive material is applied as a layer or coating, the layer or coating may have a thickness of 0.5 microns to 2 mm, for example, 1 to 100 microns.

In some examples, the printer further comprises a developer roller in contact with the photoconductive cylinder, wherein the cleaning element is positioned in spaced relation with the developer roller. The developer roller may help to apply electrophotographic ink composition onto the photoconductive cylinder's surface.

In one example, the cleaning element is provided as part of a cleaning assembly. As described above, the assembly may also comprise a wetting element for delivering liquid to the absorbent foam substrate; and a drying (e.g. squeezing) element for removing liquid from the absorbent foam substrate. In use, the wetting element may be used to deliver liquid e.g. clean imaging oil to the absorbent foam substrate, When the, or a portion of the cleaning element contacts the photoconductive cylinder, the liquid (e.g. cleaning liquid) is delivered to the photoconductive cylinder. This can aid in the abrasion of adherent contaminants and help to trap abraded contaminants to reduce the risk of such contaminants from the dispersing and reaching other parts of the printer. When the, or the portion of the cleaning element is removed from contact photoconductive cylinder, the absorbent foam material can expand and re-absorb the liquid, now containing the abraded contaminant. This contaminated liquid can be retained within the absorbent material until it is at least partly removed, for example, by the drying element.

The wetting element may be a sponge, reservoir, or brush for applying liquid (e.g. cleaning liquid) to the cleaning element. In one example, the wetting element may comprise a reservoir for the cleaning liquid, which is placed in contact with the cleaning element. The drying element may be a squeegee roller or wiper.

The wetting element may be in contact with the cleaning element. In some examples, the wetting element may be in contact with the cleaning element but not the photoconductive cylinder.

The drying element may be in contact with the cleaning element. In some examples, the drying element may be in contact with the cleaning element and the photoconductive cylinder.

The drying element may be positioned downstream of the wetting element. In some examples, parts of the cleaning element may be dried once it has been wet with imaging oil and contacted with the photoconductive cylinder.

The cleaning assembly may also include a wiper positioned downstream of the cleaning element. This wiper may be in contact with the photoconductive cylinder but not in contact with the cleaning element. Once contacted with the cleaning element, a layer of liquid (e.g. cleaning liquid) may remain on the surface of the photoconductive cylinder. The wiper may be positioned to remove or at least partially remove the liquid from the surface of the photoconductive cylinder.

The cleaning assembly may also include a cleaning sponge. In use, the cleaning sponge may be impregnated with a cleaning solution. The cleaning element may be located upstream or downstream of the cleaning sponge. In one example, the cleaning element described in the present disclosure is used in place of the cleaning sponge.

In one example, the photoconductive cylinder may be formed of any suitable material. Examples of suitable photoconductive cylinders include an organic photoconductive foil drum and an amorphous silicon photoconductive drum.

FIG. 1 shows an example electrophotographic printer 100. Cylindrical components, such as rollers, of the device 100 rotate in the directions indicated by their arrows. A photoconductive cylinder (also referred to as a "drum") 102 rotates to receive a charge transferred by a rotating charge roller 104, which is more generally a charging mechanism, across its photoconductive surface. The photoconductive drum 102 may be an organic photoconductive foil drum, an amorphous silicon photoconductive drum, or another type of photoconductive drum.

An optical discharge mechanism 106, such as a laser, selectively discharges the photoconductive drum 102 in accordance with an image to be formed onto media 116, such as paper, as the drum 102 continues to rotate. In one implementation, at least one rotating developer roller 108 transfers ink, for example dry or liquid ink or toner, to the photoconductive drum 102 as the drum 102 continues to rotate. The ink is deposited onto the photoconductive drum 102 typically just where the drum 102 has been discharged, and thus in accordance with the image to be formed.

As the photoconductive drum 102 continues to rotate with the selectively transferred colorant thereon, a rotating transfer roller 112 in one implementation transfers the ink from the drum 102 onto the media 116 that is advancing from left to right between the transfer roller 112 and a rotating impression roller 114. In another implementation, the drum 102 transfers the ink directly onto the media 116. The photoconductive drum 102 rotates past a cleaning assembly 110 to discharge its photoconductive surface and remove any ink still thereon before repeating the described process via being charged by the charge roller 104.

If ink remains on the drum 102 upon leaving the cleaning assembly 110, the ink will be exposed to the optical discharge mechanism 106. This can cause the remnant ink to react and form an adherent contaminant or deposit on the surface of the drum 102.

Figure 2:
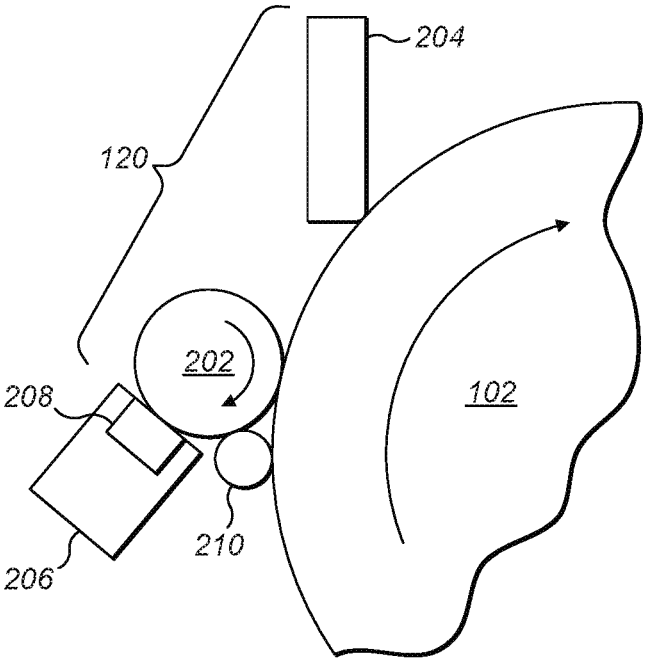
FIG. 2 is a schematic drawing of a cleaning assembly according to an example of the present disclosure.

FIG. 2 shows an example cleaning assembly 120 of the electrophotographic printing device 100. The cleaning assembly 120 may include a cleaning roller 202, and a wiper, or wiping mechanism, 204. The cleaning assembly 120 may also include a wetting element 206 positioned in contact with the cleaning roller 202. The wetting element 206 defines a reservoir 208 of liquid (e.g. imaging oil), which can be delivered to the cleaning roller 202. The reservoir 208 may be fluidly coupled to a source of the liquid (not shown). The source may be used to replenish the cleaning roller 202 and keep the cleaning roller 202 continuously moist with the liquid.

The cleaning assembly 120 may also include a drying element 210. The drying element 210 may take the form of a squeegee roller. The drying element 210 may be used to remove liquid (e.g. imaging oil) from the cleaning roller 202, for example, once the liquid has been contaminated with adherent deposits abraded from the drum 102.

Figure 3:
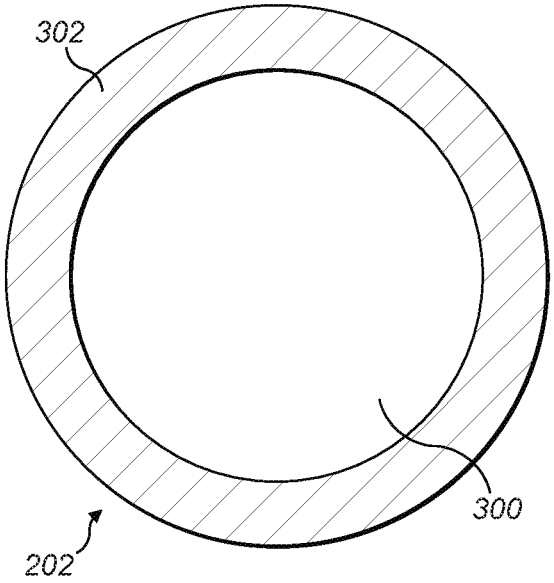
FIG. 3 is a schematic drawing of a cross-section of a cleaning element according to an example of the present disclosure.

As best seen in FIG. 3, the cleaning roller 202 comprises a resilient foam substrate 300, for example, in the form of an absorbent foam roller. The roller may be mounted on a central shaft (not shown), The substrate 300 may be formed of an open-cell polyurethane foam. Abrasive particles 302 formed, for example, of alumina may be deposited onto at least part of an outer surface of the foam substrate. The particles may be bound to the cell/pore walls and pores of the resilient foam, for example, using a binder. In some examples, the particles do not form a contiguous coating over the outer surface of the foam substrate. Instead, the coating is discontinuous so that the outer surface is provided with a rough or abrasive surface while maintaining fluid interaction with the pore structure of the foam. The abrasive particles provide the outer surface of the cleaning roller 202 with a rough surface suitable for removing any adherent deposits formed on the photoconductive drum 102. Any liquid on the drum 102 may be drawn away from the surface of the photoconductive drum 102, absorbed and at least partially retained by the resilient foam substrate 300.

In use, the wetting element 206 delivers liquid (e.g. imaging oil) to the cleaning roller 202 via reservoir 208. Because the cleaning roller 202 comprises an absorbent foam substrate 300, the liquid is absorbed by the foam substrate 300. As the photoconductive drum 102 rotates past the cleaning roller 202, the physical interaction between the cleaning roller 202 and the drum 102 causes the liquid within the foam substrate 300 to be released onto the surface of the drum 102. At the same time, the abrasive particles 302 on the outer surface of the cleaning roller 202 abrade any adherent contaminants present on the drum 102. The liquid (e.g. imaging oil) delivered onto the surface of the drum 302 by the cleaning element 202 traps at least some of the abraded contaminant particles, preventing them from reaching other parts of the cleaning assembly 120 or printer. This contaminated liquid can be absorbed and retained within the absorbent foam substrate 300. Then, as the cleaning roller 202 rotates into contact with the drying element 210, at least some of the liquid, containing the abraded contaminant particles, may be absorbed by the drying element 210. The drying element 210 may be fluidly connected to an outlet (not shown) for removing contaminated liquid (e.g. contaminated imaging oil) from the cleaning assembly 120.

Once the photoconductive drum 102 has rotated past the cleaning roller 202, a layer of the liquid may remain on the drum 102. As the photoconductive drum 102 rotates past the wiper 204, an edge of the wiper 204 that is closest to the drum 102 may wipe at least some of the liquid away from the drum 202. In some examples, only some of the liquid may be removed from the drum's 102 surface by the action of the wiper 204. Thus, a layer 210 of liquid may remain on the drum's surface as it leaves the cleaning assembly 120.

EXAMPLES

Example 1

In this example, a cleaning roller was made by spraying the outer surface of a polyurethane sponge roller with an aerosol spray comprising alumina (A-aerosol, available from ZYP® coatings, Inc.).

The cleaning element was mounted in the cleaning assembly shown in FIG. 2 and used as the cleaning roller 202. The assembly was used to clean a photoconductive drum 202 having an adherent coating of contaminants deposited on its outside surface. The cleaning roller 202 was wet with iso-paraffin and delivered via wetting element 206. As the drum 102 was rotated against cleaning roller 202, iso-paraffin was squeezed out from the cleaning roller 202 onto the surface of the drum 102. At the same time, the outer surface of the cleaning roller 202 abraded the adherent contaminants away from the drum 102. The contaminants were trapped in the iso-paraffin, which was absorbed and retained within the cleaning roller 202. As the cleaning roller 202 was rotated against the drying element 210, some of the contaminated iso-paraffin was removed and dispensed via an outlet (not shown).

The drum 102 was inspected by visual inspection and by quantified optic measurement tools (available from Filmetrics®). The cleaning roller 202 successfully removed part of the adherent coating without particles of contaminants interfering with other components of the printer. By delivering iso-paraffin onto the drum, the cleaning roller 202 also helped to control the temperature of the drum 102 to prevent it from over-heating.

Example 2

Example 1 was repeated. However, in this example, the polyurethane sponge roller was masked in selected regions prior to application of the aerosol. The resulting roller was also effective in removing part of the adherent coating. By delivering iso-paraffin onto the drum, the cleaning roller 202 also helped to control the temperature of the drum 102 to prevent it from over-heating.

Comparative Example 3

In this example, comparative rollers, 3A and 3B, were made by wrapping a non-absorbent roller with a layer of abrasive fibre and polishing film, respectively. The rollers were placed in contact with a rotating photoconductive drum having an adherent coating of contaminants deposited on its outside surface. The comparative rollers were capable of removing some adherent deposit from the surface of the drum. However, a powder formed of the abraded deposit was dispersed throughout the printer. In the case of comparative roller 3A formed using abrasive fibre, the powder adherent deposit was found to clog the fibres. As a result, the abrasive qualities of the roller were short-lived,

Comparative Example 4

In this example, comparative roller 3B was positioned in contact with a photoconductive drum, downstream of a sponge. The sponge was used to deposit iso-paraffin onto the drum upstream of the comparative roller 3B, Although the iso-paraffin helped to contain some of the abraded contaminant, it was found that abraded contaminant could not be effectively removed from the drum in an effective manner in the absence of a porous form substrate in the comparative roller 3B.

The invention claimed is:

1. An electrophotographic printer comprising
- a photoconductive cylinder,
- a cleaning element comprising an abrasive material disposed on at least an outer surface of an absorbent foam substrate, wherein at least part of said outer surface is engageable with the photoconductive cylinder, and
- a wetting element for delivering liquid to the absorbent foam substrate, wherein the wetting element is in contact with the cleaning element but not with the photoconductive cylinder.

2. The printer as claimed in claim 1, wherein the cleaning element is positioned such that at least part of said outer surface engages the photoconductive cylinder.

3. The printer as claimed in claim 1, which further comprises a drying element for removing liquid from the absorbent foam substrate.

4. The printer as claimed in claim 3, wherein the drying element comprises a squeegee roller or a wiper.

5. The printer as claimed in claim 1, wherein the absorbent foam substrate is an absorbent foam roller.

6. The printer as claimed in claim 1, wherein the absorbent foam substrate comprises an open cell foam.

7. The printer as claimed in claim 6, wherein the abrasive particles are selected from particles of silica, aluminium oxide, titanium dioxide and silicon carbide.

8. The printer as claimed in claim 1, wherein the abrasive material comprises abrasive particles.

9. The printer as claimed in claim 1, wherein the abrasive material is disposed on selected regions of the outer surface of the foam substrate.

10. The printer as claim 1, which further comprises a developer roller in contact with the photoconductive cylinder, wherein the cleaning element is positioned in spaced relation with the developer roller.

11. The printer as claimed in claim 1, wherein the wetting element comprises a sponge, reservoir, or brush for applying liquid to the cleaning element.

12. The printer as claimed in claim 1, wherein the wetting element comprises a reservoir of liquid in contact with the cleaning element, wherein the reservoir is fluidly coupled to a liquid source.

13. An apparatus for cleaning a photoconductive cylinder of an electrophotographic printer, said apparatus comprising:
- a cleaning element comprising an abrasive material disposed on at least an outer surface of an absorbent foam substrate, wherein at least part of said outer surface is engageable with the photoconductive cylinder;
- a wetting element for delivering liquid to the absorbent foam substrate, wherein the wetting element is in contact with the cleaning element but not with the photoconductive cylinder; and
- a drying element for removing liquid from the absorbent foam substrate.

14. An electrophotographic printing process comprising
- a) selectively applying a electrophotographic composition to the outer surface of a photoconductive cylinder;
- b) transferring the electrophotographic composition from the photoconductive cylinder onto a print substrate;

c) contacting the photoconductive cylinder with a cleaning element comprising an abrasive material disposed on at least an outer surface of an absorbent foam substrate, wherein the abrasive material contacts the photoconductive cylinder and at least partially removes any remnant electrophotographic composition from the photoconductive cylinder, and wetting the cleaning element by delivering liquid to the absorbent foam substrate using a wetting element that is in contact with the cleaning element but not with the photoconductive cylinder.

15. The process as claimed in claim 14, wherein a portion of the electrophotographic composition that is selectively applied to the photoconductive cylinder is exposed to a plasma causing an adherent contaminant layer to form on the photoconductive cylinder surface.

16. The process as claimed in claim 15, wherein the adherent contaminant layer is abraded by contact with the abrasive material, and wherein remnant liquid on the photoconductive cylinder is absorbed by the absorbent foam substrate.

17. The process as claimed in claim 14, which comprises contacting the cleaning element with the photoconductive cylinder while the cleaning element is wet, wherein the abrasive material contacts the photoconductive cylinder and at least partially removes any remnant electrophotographic composition from the photoconductive cylinder; and, thereafter, drying at least some of the liquid from the cleaning element.

* * * * *